US007940217B2

(12) United States Patent
Howard et al.

(10) Patent No.: US 7,940,217 B2
(45) Date of Patent: May 10, 2011

(54) TREE TRUNK ANTENNA

(75) Inventors: John Howard, Upper Mount Bethal, PA (US); Charilaos Paraskevaidis, East Hanover, NJ (US)

(73) Assignee: ET Industries, Inc., Boonton, NJ (US)

( * ) Notice: Subject to any disclaimer, the term of this patent is extended or adjusted under 35 U.S.C. 154(b) by 120 days.

(21) Appl. No.: 12/200,329

(22) Filed: Aug. 28, 2008

(65) Prior Publication Data

US 2009/0058753 A1 Mar. 5, 2009

Related U.S. Application Data

(60) Provisional application No. 60/967,043, filed on Aug. 31, 2007.

(51) Int. Cl.
*H01Q 1/38* (2006.01)

(52) U.S. Cl. ..... 343/700 MS; 343/846

(58) Field of Classification Search ..... 343/700 MS, 343/846, 841

See application file for complete search history.

(56) References Cited

U.S. PATENT DOCUMENTS

| | | | | |
|---|---|---|---|---|
| 5,442,336 | A | 8/1995 | Murphy et al. | |
| 5,572,222 | A | 11/1996 | Mailandt et al. | |
| 5,777,583 | A | 7/1998 | Canora et al. | |
| 6,087,990 | A * | 7/2000 | Thill et al. | 343/700 MS |
| 6,100,846 | A | 8/2000 | Li et al. | |
| 6,359,588 | B1 | 3/2002 | Kuntzsch | |
| 6,480,170 | B1 | 11/2002 | Langley et al. | |
| 6,982,672 | B2 * | 1/2006 | Lin et al. | 343/700 MS |
| 6,995,709 | B2 * | 2/2006 | Spittler | 343/700 MS |
| 7,256,752 | B2 | 8/2007 | Wither et al. | |
| 7,298,333 | B2 * | 11/2007 | Iluz et al. | 343/700 MS |
| 7,425,922 | B1 * | 9/2008 | Adams | 343/700 MS |
| 2007/0080864 | A1 | 4/2007 | Channabasappa | |

* cited by examiner

*Primary Examiner* — Hoang V Nguyen
(74) *Attorney, Agent, or Firm* — Hoffman & Baron, LLP

(57) ABSTRACT

Embodiments of the present invention include a patch antenna having a patch element, a ground plane, a feedline, and an electromagnetic shield. The patch element transmitting and/or receives electromagnetic signals. The ground plane is spaced at a specified distance from the patch element. The feedline guides the electromagnetic signal and extends through an opening in the ground plane and to the patch element. The feedline is electrically coupled to the patch element to guide an electromagnetic signal to or from the patch element. The electromagnetic shield extends, at least partially, between the ground plane and the patch element and is electrically coupled to the ground plane. The electromagnetic shield is configured to control an impedance associated with the feedline between the ground plane and the patch element.

19 Claims, 2 Drawing Sheets

TREE TRUNK ANTENNA

CROSS-REFERENCE TO RELATED APPLICATION

The present application claims priority to U.S. Provisional Patent Application Ser. No. 60/967,043 filed Aug. 31, 2007, the disclosure of which is incorporated herein by reference in its entirety.

BACKGROUND OF THE INVENTION

1. Field of the Invention

The present invention generally relates to antennas, and more particularly to patch antennas.

2. Brief Discussion of Related Art

Patch antennas can transmit and/or receive electromagnetic waves. Free-space electromagnetic waves propagating through a medium, such as air, are received by patch antennas, which can transform these electromagnetic waves into guided electromagnetic waves by inducing such waves on feedlines of the patch antennas. The induced guided electromagnetic waves can be fed into an integrated circuit that can decipher the information from the received waves. To transmit information, patch antennas can generate guided electromagnetic waves on the feedline, which can induce an electric field surrounding the antenna to form a free-space propagating electromagnetic wave that radiates from the patch antenna.

Performance of a patch antenna is typically dependent on a distance of a patch element of the patch antenna from a ground plane of the patch antenna. For example, in conventional patch antennas, patch elements that are spaced at a closer distance to the ground plane generally have a higher quality factor (Q) than patch elements spaced at greater distance from the ground plane. As a result, the bandwidth of a conventional patch antenna decreases as patch elements move closer to the ground plane and increases as the patch elements move farther away from the ground plane.

Conventional feedline configurations can have the effect of limiting the bandwidth by introducing reactance and, in certain cases, by introducing its own radiation effects. As a result, the performance of conventional patch antennas is generally limited by these conventional feedline configurations. Thus, there is a desire for patch antennas that reduce and/or eliminate deleterious effects of feedline configurations to improve the performance of patch antennas.

SUMMARY OF THE INVENTION

In some aspects, a patch antenna that includes a patch element, a ground plane, a feedline, and an electromagnetic shield is disclosed. The patch element transmits and/or receives an electromagnetic signal. The ground plane is spaced at a specified distance from the patch element. The feedline guides the electromagnetic signal and extends through an opening in the ground plane and to the patch element. The feedline is electrically coupled to the patch element to guide an electromagnetic signal to or from the patch element. The electromagnetic shield extends, at least partially, between the ground plane and the patch element and is electrically coupled to the ground plane. The electromagnetic shield is configured to control an impedance associated with the feedline between the ground plane and the patch element.

In another aspect, a device for transmitting an electromagnetic signal and/or receiving an electromagnetic signal is disclosed. The device includes a first conductor, a second conductor, a third conductor, and a fourth conductor. The first and second conductors have a substantially planar configuration. The second conductor is spaced away from, and substantially parallel to, the first conductor. The third conductor extends through an opening in the second conductor and to the first conductor. The third conductor is electrically coupled to the patch element to guide an electromagnetic signal to the patch element. The fourth conductor is coaxially disposed about the third conductor and at least partially extends between the ground plane and the patch element. The fourth conductor is electrically coupled to the second conductor to control an impedance associated with the third conductor.

In yet another aspect, a method of forming a patch antenna is disclosed. The method includes disposing a patch element on a substrate. The patch element has a substantially planar configuration and is formed of a conductive material. The method also includes forming a ground plane that has a substantially planar configuration and that is formed of a conductive material. The ground plane is substantially parallel to, and spaced apart from, the patch element to form a space between the ground plane and the patch element. The method further includes forming a feeding network for carrying guided electromagnetic waves and controlling an impedance of the feedline with an electromagnetic shield disposed between the ground plane and the patch element. The feeding network includes a feedline extending through the ground plane and the substrate and is electrically coupled to the patch element. The electromagnetic shield is electrically coupled to the ground plane.

Other objects and features of the present invention will become apparent from the following detailed description considered in conjunction with the accompanying drawings. It is to be understood, however, that the drawings are designed as an illustration only and not as a definition of the limits of the invention.

DETAILED DESCRIPTION OF THE PREFERRED EMBODIMENTS

The preferred embodiments of the inventions include patch antennas that reduce and/or eliminate deleterious effects of feedline configurations of conventional patch antennas. The patch antennas can include one or more conductive patch elements configured to extend generally parallel to a ground plane. The patch elements are generally spaced at a specified distance from a ground plane. Feedlines can be routed through openings in the ground plane and can be attached to patch elements. The feedlines can be implemented using coaxial cable having a center conductor and an outer conductor, which can be used to provide a grounded electromagnetic shield. Depending on the application, patch antennas can include a single radiating patch element or an array of patch elements. Patch antennas can provide a low-profile, lightweight structure that can easily be manufactured.

Figure 1:
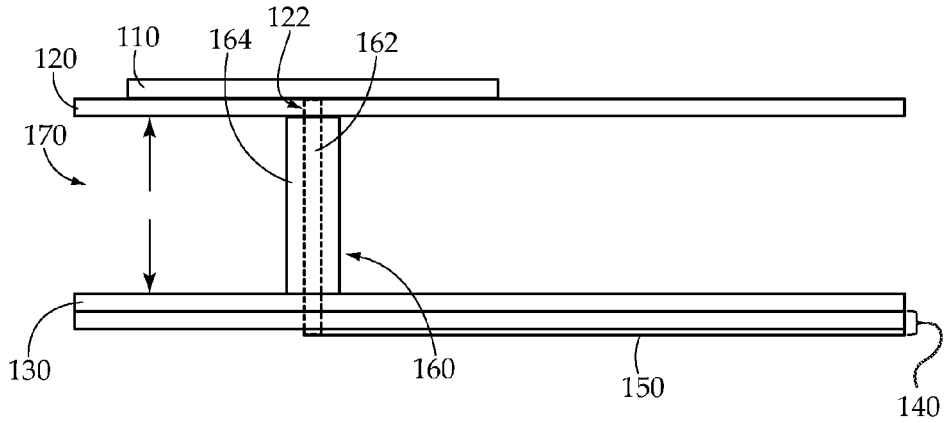
FIG. 1 depicts a side cross-sectional view of a patch antenna in accordance with a preferred embodiment of the present invention.
Figure 2:
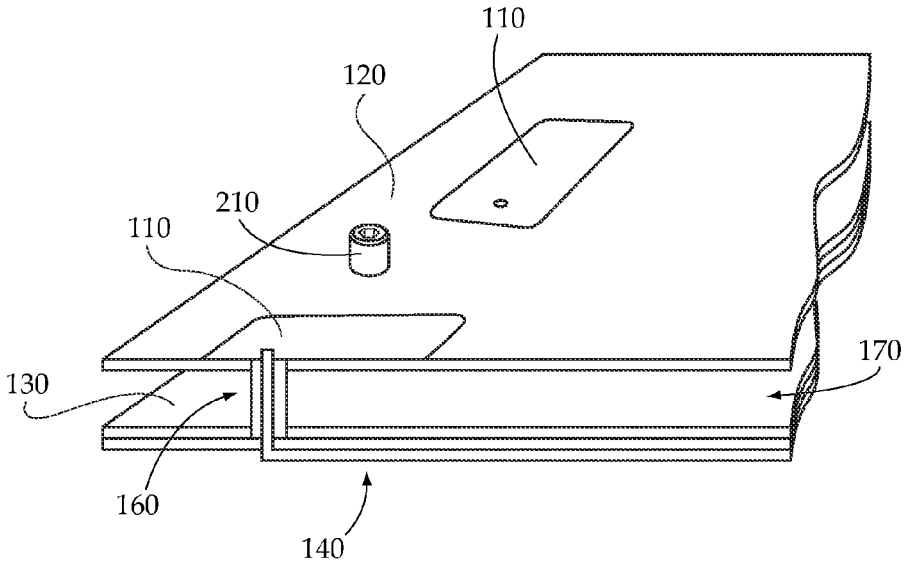
FIG. 2 depicts a top and side view of the patch antenna of FIG. 1.
Figure 3:
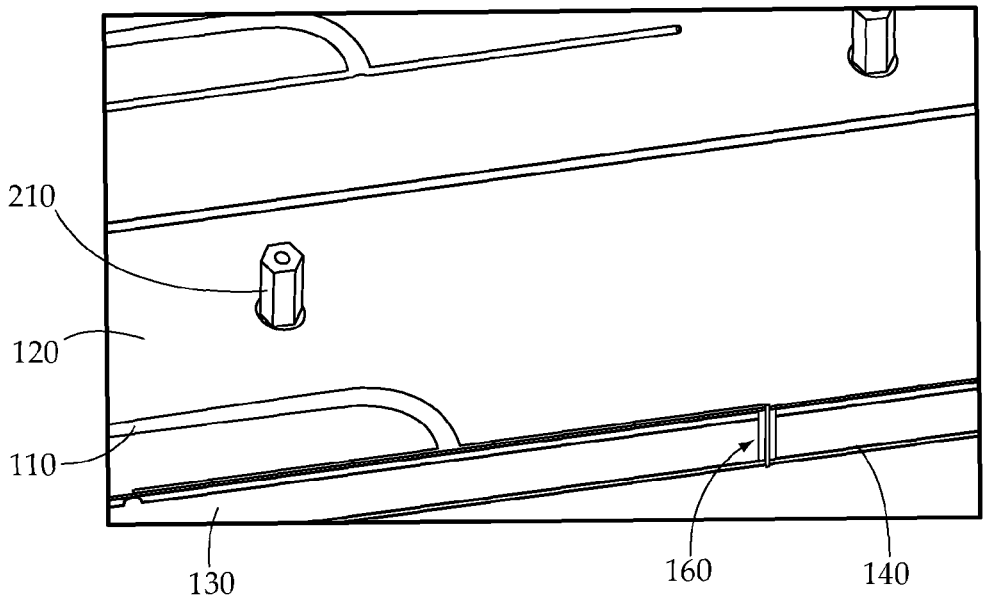
FIG. 3 depicts another top and side view of the patch antenna of FIG. 1.

FIGS. 1-3 depict a patch antenna 100 that includes one or more patch elements 110, substrate 120, ground plane 130, microstrip feeding network 140 including feedline 150, which can have one or more coaxial cable sections 160.

The patch elements 110, substrate 120, and ground plane 130 preferably have a planar configuration. The patch elements 110 are preferably disposed on the substrate 120. In one embodiment, an array of patch elements 110 can be formed, where each patch element 110 of the array is spaced at a specified distance from the other patch elements 110 of the array. The patch elements 110 and substrate 120 are preferably positioned at a fixed distance away from the ground plane 130 to create a space 170 that is filled with a medium, such as air. The substrate 120 and the space 170 form two dielectrics of the patch antenna 100 between the patch elements 110 and the ground plane 130. Standoffs 210, as shown in FIGS. 2 and 3, or other support structures, can be used to maintain the distance between the patch elements 110 and the ground plane 130. The standoffs 210 preferably extend in a generally orthogonal manner between the substrate 120 and the ground plane 130 in the space 170.

The substrate 120 and the ground plane 130 preferably have openings 122 and 132, respectively, for receiving at least a portion of the coaxial cable section 160. The openings 122 in the substrate 120 are preferably positioned under at least a portion of the patch elements 110. The ground plane 130 can include an inner surface 134 and an outer surface 136.

A transmission line that feeds the patch elements 110 is preferably formed from the microstrip feeding network 140 including the feedline 150, which can have the coaxial cable section 160. The microstrip feeding network 140 shares the same ground as the radiating patch elements 110, but the ground of the patch elements 110 is electrically coupled to the inner surface 134 of the ground plane 130 and the ground of the micro feeding network 140 is electrically coupled to the outer surface 136 of the ground plane 130 so that the grounds are on opposite sides of the ground plane 130. The electrical coupling can be formed using solder, or other suitable techniques.

The openings 122 and 132 are preferably aligned so that a portion of the coaxial cable section 160 is operatively coupled between the patch elements 110 and the microstrip feeding network 140. The microstrip feeding network 140, and more specifically, the feedline 150, preferably carries guided electromagnetic waves that represent a signal to be radiated by the patch antenna 100 as a free-space electromagnetic wave and/or signals received by the patch antenna.

The coaxial cable sections 160 preferably include a center conductor 152 and an outer conductor 164, which can provide a grounded electromagnetic shield for the center conductor. Each center conductor 162 of the coaxial cable section 160 preferably extends from the microstrip feeding network 140, positioned on the outer surface of the ground plane 130, to the patch elements 110 through the openings 132 of the ground plane 130, space 170, and openings 122 of the substrate 120. Each center conductor 162 is preferably communicatively coupled to the feed network and the patch elements 110 to carry the guided electromagnetic wave to the patch elements 110.

The outer conductor 164 of the coaxial cable section 160 preferably surrounds the center conductor 162 in a coaxial manner and is formed from one or more discrete conductors. The outer conductor 164 extends for at least a portion of the distance between the patch elements 110 and the ground plane 130 and preferably extends from the ground plane to the substrate 120. The outer conductor 164 is preferably electrically coupled to the ground plane 130. As a result, the ground of the antenna is composed of the ground plane 130, which can be formed from a generally planer metallic sheet under, and spaced away from, the patch elements 110, and the outer conductors 164 of the coaxial cable 160. This configuration advantageously enables precise control of the impedance associated with the transmission line until it reaches the patch elements 110.

Extending the outer conductor 164 of the coaxial cable section 160 can reduce and/or eliminate reactive and radiation effects associated with conventional feedlines without diminishing the frequency bandwidth of operation. As such, deleterious effects associated with conventional feedline configurations are reduced and/or eliminated.

The preferred configuration disclosed in FIG. 1-3 can be used to form an array of patch elements 110 in the patch antenna 100. As a result of the preferred configuration, a large separation between the patch elements 110 and the ground plane 130 can be used while avoiding impedance variation that can occur before the transmission line reaches the patch elements; thereby maintaining a good Voltage Standing Wave Ratio (VSWR). Thus, the disclosed configuration can be advantageously used to implement an antenna with a wide frequency of operation.

Although illustrative embodiments of the present invention have been described herein with reference to the accompanying drawings, it is to be understood that the invention is not limited to those precise embodiments, and that various other changes and modifications may be affected therein by one skilled in the art without departing from the scope or spirit of the invention.

What is claimed is:

1. A patch antenna comprising:

a patch element for at least one of transmitting and receiving an electromagnetic signal;

a first dielectric element disposed adjacent to the patch element;

a ground plane spaced at a specified distance from the first dielectric element to form a space between the first dielectric element and the ground plane, the patch element being disposed outside of the space;

a second dielectric element disposed in the space;

a feedline for guiding the electromagnetic signal, the feedline extending through an opening in the ground plane, the second dielectric element, and the first dielectric element to the patch element, the feedline being electrically coupled to the patch element to guide an electromagnetic signal to or from the patch element; and an electromagnetic shield extending, at least partially, into the second dielectric element, the electromagnetic shield being electrically coupled to the ground plane and shielding at least a portion of the feedline from the electromagnetic radiation to control an impedance associated with the feedline in the second dielectic element, wherein the electromagnetic shield is bounded by the ground plane and the first dielectric so that the feedline is at least partially shielded through the second dielectric and is unshielded through the first dielectric.

2. The patch antenna of claim 1, wherein the electromagnetic shield substantially surrounds the feedline.

3. The patch antenna of claim 1, wherein the electromagnetic shield is positioned coaxially with relation to the feedline.

4. The patch antenna of claim 1 further comprising:

a substrate upon which the patch element is disposed; and a medium disposed between the substrate and the ground plane, wherein the electromagnetic shield surrounds the feedline between the ground plane and the substrate.

5. The patch antenna of claim 1 further comprising:

an array of patch elements, the patch elements of the array being coplanar with respect to each other and begin spaced a specified distance from each other.

6. The patch antenna of claim 1, wherein the electromagnetic shield is formed from a plurality of discrete electrical conductors.

7. The patch antenna of claim 1, wherein the electromagnetic shield is formed from a single continuous electrical conductor.

8. A device for at least one of transmitting an electromagnetic signal and receiving an electromagnetic signal comprising:

a first conductor having a substantially planar configuration;

a first dielectric material disposed adjacent to the first conductor and having a substantially planar configuration;

a second conductor having a substantially planar configuration, the second conductor being spaced away from, and substantially parallel to, the first dielectric material to form a space between the first dielectric material and second conductors;

a second dielectric material disposed in the space;

a third conductor extending through an opening in the second conductor into and across the second dielectric material and the first dielectric material and to the first conductor, the third conductor being electrically coupled to the first conductor to guide an electromagnetic signal to the first conductor; and a fourth conductor coaxially disposed about the third conductor within the second dielectric material, the fourth conductor extending into the second dielectric material so that the fourth conductor is bounded by the second conductor and the first dielectric material, the fourth conductor being electrically coupled to the second conductor and shielding at least a portion of the third conductor from electromagnetic radiation to control an impedance associated with the third conductor in the second dielectric material, the third conductor being at least partially shielded through the second dielectric material and being unshielded through the first dielectric material.

9. The device of claim 8, wherein the fourth conductor substantially surrounds the third conductor.

10. The device of claim 8 further comprising:

a substrate upon which the first conductor is disposed; and a medium disposed between the substrate and the second conductor, wherein the fourth conductor surrounds the third conductor between the second conductor and the substrate.

11. The device of claim 8 further comprising:

an array of conductive elements that includes the first conductor, the conductive elements of the array being coplanar with respect to each other and begin spaced a specified distance from each other.

12. The device of claim 8, wherein the fourth conductor is formed from a plurality of discrete electrical conductors.

13. The device of claim 8, wherein the fourth conductor is formed from a single continuous electrical conductor.

14. A method of forming a patch antenna comprising:

disposing a patch element on a substrate, the patch element having a substantially planar configuration and comprising a conductive material, the substrate having a substantially planar configuration and comprising a first dielectric material;

forming a ground plane, the ground plane having a substantially planar configuration and comprising a conductive material, the ground plane being substantially parallel to, and spaced apart from the substrate to form a space between the ground plane and the substrate, a second dielectric material being disposed in the space;

forming a feeding network for carrying guided electromagnetic waves, the feeding network including a feedline extending through the ground plane, the second dielectric material, and the substrate, and being electrically coupled to the patch element;

controlling an impedance of the feedline with an electromagnetic shield disposed within the space between the ground plane and the substrate, the electromagnetic shield being bounded by the ground plane and the substrate and being electrically coupled to the ground plane, at least a portion of the feedline being shielded from the electromagnetic radiation through the second dielectric material and being unshielded through the first dielectric material.

15. The method of claim 14 further comprising substantially surrounding feedline with the electromagnetic shield between the ground plane and the substrate.

16. The method of claim 14 further comprising positioning the electromagnetic shield with relation to the feedline.

17. The method of claim 14 further comprising disposing an array of patch elements on the substrate, the patch elements of the array being coplanar with respect to each other and begin spaced a specified distance from each other.

18. The method of claim 14 further comprising forming the electromagnetic shield from a plurality of discrete electrical conductors.

19. The method of claim 14 further comprising forming the electromagnetic shield from a single continuous electrical conductor.

* * * * *